United States Patent [19]

Kreckel

[11] 3,963,587

[45] June 15, 1976

[54] PROCESS FOR ELECTROFORMING NICKEL FOILS

[75] Inventor: Douglas A. Kreckel, Webster, N.Y.

[73] Assignee: Xerox Corporation, Stamford, Conn.

[22] Filed: May 19, 1975

[21] Appl. No.: 578,782

[52] U.S. Cl. ..... 204/9; 204/4; 204/43 T; 204/49

[51] Int. Cl.[2] ..... C25D 1/02; C25D 3/56

[58] Field of Search ..... 204/3, 9, 4, 49, 43 T, 204/281, 12

[56] References Cited

UNITED STATES PATENTS

| | | | |
|---|---|---|---|
| 2,453,668 | 11/1948 | Marisic et al. | 204/49 |
| 3,239,437 | 3/1966 | Stephen | 204/43 |
| 3,326,782 | 6/1967 | Kendrick et al. | 204/3 |
| 3,844,906 | 10/1974 | Bailey et al. | 204/9 |

*Primary Examiner*—T. M. Tufariello

[57] ABSTRACT

A method for electroforming relatively smooth seamless nickel, cobalt or nickel-cobalt alloy foil cylinders from an electrolyte for nickel or cobalt is provided comprising slowly increasing the current density from zero to its ultimate current density at the start up of the plating cycle.

20 Claims, No Drawings

PROCESS FOR ELECTROFORMING NICKEL FOILS

BACKGROUND OF THE INVENTION

This invention is directed to the art of electroforming in which a smooth surface of nickel cobalt or nickel-cobaltalloy is formed on a conductive substrate (mandrel) from an electrolyte for nickel or cobalt. Typical baths are formed from the acids and their nickel and/or cobalt salts to include sulfamic acid, sulfuric acid, hydrochloric acid, hydrobromic acid, methanesulfonic acid, fluoboric acid, pyrophosphoric acid, and mixtures with or without boric acid and/or acetic acid. A typical bath is formed of a nickel sulfamate solution comprising about 10 to 16 oz/gal total nickel, about 0.9 to 4.5 oz/gal halide as $NiX_2.6H_2O$ and about 4.5 to 6.0 oz/gal $H_3BO_3$. Such baths are normally maintained at a temperature of between about 135°F and about 160°F at an ultimate current density of between about 200 and about 600 ASF (amperes per square foot). At the start of electrodeposition, the current density normally increases to its ultimate value within about 5 seconds. Because of the relatively high current density and various contaminants in the bath, it has been difficult to form a nickel surface which is sufficiently smooth to be useful as a photoreceptive substrate in an electrostatographic copying machine. For best results, the outside surfaces of these nickel foil cylinders ("belts") should have a surface roughness not more than about 50 microinches, arithmetic average (AA). Surface roughness as used herein is determined by the standard set forth by the American Society of Mechanical Engineers ASA B46.1 - 1962. Unfortunately, however, belts commonly produced under the optimum aforesaid conditions may have a surface roughness of up to 80 microinches AA. It is to this problem to which this invention is directed.

BRIEF DESCRIPTION OF THE INVENTION

It is now been discovered that smooth nickel belts can be electroformed having a surface roughness between about 20 and 50 microinches AA by raising the current density to its ultimate current density relatively slowly at the beginning of the plating cycle. It is not necessary to vary the current density through the plating cycle but rather it is sufficient that a lower current density be maintained for as little as 2 percent of the total plating time. Although the period at which the current density is less than the ultimate current density will vary depending on factors such as ultimate current density, the composition of the bath and the like and the rate at which the current is raised from zero to its ultimate current density, the current density can be raised to its ultimate current density when 20 percent of the plating period has elapsed while still obtaining nickel surfaces having a surface roughness of less than about 50 microinches AA; and under the preferred conditions the ultimate current density can be reached within the first 10 percent of the plating cycle. The electrodeposition is carried out on a cylindrical conductive mandrel rotating in the electrolyte at such a rate as to cause fully developed turbulence near the cathode surface. Preferably, the mandrel is an aluminium cylinder with a smooth chromium surface, said cylinder having a diameter from between about 4 and 30 inches.

DETAILED DESCRIPTION OF THE INVENTION

More particularly, the smooth surfaced nickel belt or foil is obtained by electroforming onto a cylindrical mandrel as in U.S. Pat. No. 3,844,906, by increasing the current density from zero at an average rate of between about 75 ASF/min and 600 ASF/min (amperes per square foot) over the first 5 to 20 percent of the plating cycle to an ultimate current density of between about 200 and 600 ASF. Preferably, the current density is increased at an average rate of between about 100 and about 400 ASF per minute to an ultimate current density of between about 250 and about 350 ASF. The current density is then preferably maintained within about 5 percent of its ultimate current density during the second half of the plating period. The length of the period in which the current is less than ultimate, as previously noted, will depend upon several factors. Under optimum conditions, however, the period can be reduced to as little as 2 percent of the total plating time.

While previously the ultimate current density was obtained in about 3 seconds, in accordance with this invention, the current is raised from zero at a reduced rate by either stepwise additions or a ramp rise. A stepwise addition is one in which the current density is maintained at a constant level for a brief period of time and then raised to the ultimate current density or to one or more levels prior to reaching its ultimate current density. A ramp rise is one in which the current is slowly increased from zero to the ultimate current density without any appreciable period at a constant current density. It appears that both the stepwise increase and ramp rise produces essentially the same result, the determining factor being the level at which the current density is maintained during the initiation or shortly after the start of the plating cycle. If the current is interrupted for any reason, this is not deleterious. More particularly, it appears that best results are obtained when the initial current density is maintained at less than about 50 percent of its ultimate amperage for a period of up to 15 percent of the total plating time and preferably at less than about 25 percent of its ultimate amperage for a period of about 5 to 15 percent of the total plating time. This will be more apparent, however, from the appended examples. In addition, it is preferred that the initial current density be from about 5 to 150 ASF over the first 15 seconds, and preferably the first 30 seconds of the plating period. Further, the current is preferably raised from 0 to 300 ASF during the first 120 seconds of the plating cycle.

The smooth nickel, cobalt or nickel cobalt alloy seamless belt can be formed as illustrated and described in U.S. Pat. No. 3,844,906, which is herein incorporated by reference in its entirety. The belt formed may have a thickness between about 0.002 inches and about 0.02 inches, typically between about 0.004 inches and about 0.006 inches. In order to be suitable for use as the substrate for the image retention surface in an electrostatographic apparatus, it is important that the belt exhibit a high degree of thickness uniformity and a controlled degree of surface roughness.

Generally, the current densities employed in the present invention range from about 200 and about 600 ASF with a preferred ultimate current density of between about 250 and about 350 ASF and most preferably about 300 ASF. In order to minimize plant and equipment cost at optimum throughput, it is considered preferable to operate at both high current densities and high current concentrations. Generally, current concentrations (defined as the ratio of total current flowing to total electrolyte volume) range from about 5 to 25 amps/gal. At lower current concentrations wherein larger solution volumes are required per unit produced, costs for equipment and floor space become economically unattractive.

The control of the current density is not restricted to electronic means. For example, in some applications such as the continuous plating onto and stripping foil from a revolving partially immersed cylinder, the ramp current application may be effected by mechanical means rather than the electronically regulated method illustrated in the subject disclosure. For example, in the continuous electroforming of foil, a practical method would be to restrict the amount of current going to the freshly exposed surface revolving into the electrolyte by mechanical shades. As the revolving surface rotates by and beyond the shade, an increase in current density would be effected. The rate of increase would depend on the rate of revolution.

Preferably, for continuous, stable operation with high throughput and high yield of acceptable belts, a suitable electrolyte such as a nickel sulfamate solution is maintained at a steady state composition within the electroforming zone comprising:

| | |
|---|---|
| Total Nickel | 12.0 to 15.0 oz/gal |
| Chloride as $NiCl_2.6H_2O$ | 1.6 to 1.7 oz/gal |
| $H_2$ *nos* | 5.0 to 5.4 oz/gal |
| pH | 3.8 to 4.1 |
| Surface Tension | 33 to 50 dynes/cm$^2$ |

Additionally, from about 1.3 to 1.6 $\times 10^{-4}$ moles of a stress reducing agent per mole of nickel electrolytically deposited from said solution is continuously charged to said solution. Suitable stress reduction agents are sodium sulfobenzimide (saccharin), 2-methylbenzenesulfonamide, benzene sulfonate, naphthalene trisulfonate and mixtures thereof.

Saccharin has long been known as being effective in reducing the stress in electrodeposits (as well as grain refining). In the present invention, it has been found possible to use saccharin effectively at extremely low concentrations. Furthermore, a principal degradation product of saccharin, 2-methylbenzenesulfonamide (2-MBSA), has been found nearly as effective as saccharin itself in controlling stress. Still further, saccharin and 2-MBSA together form a system which tends to mask or minimize the effects of temporary, independent fluctuations in the levels of either component.

It has been found that maintaining a high total nickel content of from 10.0 to 16.0 oz/gal and preferably, from 12 to 15 oz/gal enables a high output of acceptable belts to be obtained on a continuous basis. Further, it has been found that operation in this range results in a reduction in the reject rate for surface flaws from greater than 50 percent to less than 20 percent. Also, it has been found that, even in the presence of a stress reducing agent, at total nickel concentrations above about 10 oz/gal, surface roughness tends to increase with increasing nickel concentration. Whereas, at total nickel concentrations below about 14 oz/gal an increase in surface flaws is encuntered.

The following examples will serve to illustrate the invention and preferred embodiments thereof. All parts and percentages in said examples and elsewhere in the specification and the claims are by weight unless otherwise specified.

EXAMPLE I

In accordance with the general procedure of Examples I-XIV of U.S. Pat. No. 3,844,906 in which a cylindrical mandrel is rotated within a conforming cylindrical anode, a plurality of nickel belts were electroformed on a chromium coated aluminum mandrel about 20 inches in diameter and rotated at about 60 revolutions per minute from an electrolytic solution comprising:

| | | |
|---|---|---|
| Chloride as $NiCl_2.6H_2O$ | 1.64 | oz/gal |
| Total Nickel (from $NiCl_2.6H_2O$ and nickel sulfamate) | 13.6 | oz/gal |
| $H_3BO_3$ (boric acid) | 5.2 | oz/gal |

at a pH of 3.8 and a nominal temperature of 152°F. Sodium saccharin was added to maintain a concentration of about 15 mg/l and sodium lauryl sulfonate was added to maintain a surface tension of about 45 dynes/cm. The deposition time was approximately 18 ½ minutes. About 3 seconds was required for the current density to reach its maximum value after the current was turned on.

Nickel belts produced over a two day period under the above conditions exhibited an average surface roughness of about 64 microinches (AA). Six belts produced during those two days under the same conditions but for the exception that the current density was raised stepwise as follows:

50 ASF for 30 seconds
125 ASF for 20 seconds
300 ASF for the remaining 17 ½ minutes exhibited an average surface roughness of 34 microinches (AA), a reduction of 47 percent.

EXAMPLE II

The conditions of Example I were essentially duplicated except that the plating temperature was about 160°F. Belts plated with the current density attaining 300 ASF within about 3 seconds averaged 53 microinches. When the current density was raised stepwise as in Example I, the belts averaged 24 microinches (AA) on one three-belt sample and 32 microinches (AA) on another; an average reduction of 47 percent.

EXAMPLE III

In accordance with the operating conditions of Example I and wherein the current density reached its ultimate value of 300 ASF within about 3 seconds, the average surface roughness of several belts produced was 63 microinches (AA).

When the current density was raised in a smooth ramp, increasing linearly with time to about 300 ASF followed by 17 ½ to 18 minutes at 300 ASF, the following results were obtained:

| Average Reduction | Duration of Ramp | Roughness |
|---|---|---|
| 24% | 30 seconds | 48 microinches (AA) |
| 32% | 60 seconds | 43 microinches (AA) |

EXAMPLE IV – IX

The procedure of Example I was repeated but for the exception that the bath contained:

| | | |
|---|---|---|
| Chloride as $NiCl_2.6H_2O$ | 1.26 | oz/gal |
| Total Nickel (from nickel sulfamate) | 10.5 | oz/gal |
| Boric Acid | 5.2 | oz/gal |

The average surface roughness of the belts was 50 microinches (arithmetic average, AA) when the current density of 300 ASF was achieved within about 3 seconds.

When the current was applied as indicated in the following table with a total deposition time of about 18 ½ minutes, the average surface roughness (AA) was reduced by the amounts noted:

| Example | Treatment | Reduction |
|---|---|---|
| IV | 20 seconds at 50 ASF, remainder at 300 ASF | 14% |
| V | 40 seconds at 50 ASF, remainder at 300 ASF | 32% |
| VI | 60 seconds at 50 ASF, remainder at 300 ASF | 48% |
| VII | 60 seconds at 100 ASF, remainder at 300 ASF | 14% |
| VIII | 60 seconds at 150 ASF, remainder at 300 | 8% |
| IX | 60 seconds linear increase to 300 ASF, remainder at 300 ASF | 26% |

EXAMPLE X

The procedure of Example I was repeated with an electrolyte composition adjusted to the following nominal values:

| | | |
|---|---|---|
| Chloride as $NiCl_2.6H_2O$ | 1.65 | oz/gal |
| Total Nickel (from nickel sulfamate) | 15.5 | oz/gal |
| Boric Acid | 5.2 | oz/gal |

The current density was increased linearly from 0 to 300 ASF over 2 minutes and then plated for about 16 ½ minutes at 300 ASF. The average surface roughness was reduced by about 15% from that when the current density is allowed to attain 300 ASF within about 3 seconds.

Having described the present invention with reference to these specific embodiments, it is to be understood that numerous variations can be made without departing from the spirit of the invention and it is intended to encompass such reasonable variations or equivalents within its scope.

What is claimed is:

1. In a method of electroforming a smooth surface of nickel cobalt or alloy thereof on a conductive substrate from which it may subsequently be removed from a nickel sulfamate electroforming solution, the improvement comprising increasing the current density from zero at an average rate of between about 75 to 600 ASF per minute over the first 2 to 20 percent of the plating cycle to an ultimate current density of between about 200 and about 600 ASF, and the ultimate current concentration is between about 5 and about 15 amperes per gallon of electroforming solution.

2. The method of claim 1 wherein the current density is increased at an average rate of between about 100 and about 400 ASF per minute to the ultimate current density.

3. The method of claim 1 wherein the electrolyte contains total nickel of from about 12 to about 15 oz/gal.

4. The method of claim 1 wherein the amount of total nickel constitutes from about 13.5 to about 14 oz/gal.

5. The method of claim 1 in which the electrolyte contains nickel and chloride as $NiCl_2.6H_2O$ and the ratio of chloride as $NiCl_2.6H_2O$ to total nickel is from about 0.10 to about 0.14.

6. The method of claim 1 in which the electrolyte contains nickel and bromide.

7. The method of claim 1 wherein the current density is initially maintained at less than about 50 percent of its ultimate amperage for a period of up to 15 percent of the total plating time.

8. The method of claim 1 wherein the current density is initially maintained at less than about 50 percent of its ultimate amperage for a period of up to 5 to 15 percent of the total plating time.

9. The method of claim 1 wherein the current density is initially maintained at less than about 25 percent of its ultimate amperage for a period of up to 5 to 15 percent of the total plating time.

10. The method of claim 1 wherein the ultimate current density is between about 250 and about 350 ASF, and the current density is maintained within about 5 percent of its ultimate current density during the second half of the plating period.

11. The method of claim 1 wherein the current density is from 5 to 150 ASF over the first 15 seconds of the plating cycle.

12. The method of claim 1 wherein the current density is from 5 to 150 ASF over the first 30 seconds of the plating cycle.

13. The method of claim 1 in which the conductive substrate is cylindrical and is rotated within a conforming cylindrical anode

14. The method of claim 13 in which the cylinder is rotated to maintain a turbulent flow near the cathode surface.

15. The method of claim 1 wherein the current is raised from 0 to 300 ASF during the first 120 seconds of the plating cycle.

16. The method of claim 1 wherein the conductive substrate is comprised of an aluminum cylinder having a smooth, chromium surface.

17. The method of claim 1 wherein the nickel foil formed is between 0.004 and 0.006 inches thick.

18. The method of claim 1 wherein the conductive substrate is comprised of an aluminum cylinder having a smooth chromium surface and is from about 4 inches in diameter to about 30 inches in diameter.

19. In a method of electroforming a smooth surface of nickel on a conductive substrate from which it may subsequently be removed from a nickel sulfamate electroforming solution, of 10 to 16 oz/gal total nickel, 0.9 to 4.5 oz/gal halide as $NiX_2.6H_2O$ and 4.5 to 6.0 oz/gal $H_3BO_3$, at a temperature of between about 140°F and about 160°F, the improvement comprising increasing the current density from zero at an average rate of between about 75 and 600 ASF per minute over the first 2 to 50 percent of the plating cycle to an ultimate current density of between about 200 and about 600 ASF, and the ultimate current concentration is between about 5 and about 15 amperes per gallon of electroforming solution.

20. The method of claim 19 wherein the current density is increased at an average rate of between about 100 and about 400 ASF per minute to the ultimate current density.

* * * * *